United States Patent [19]

Ashworth et al.

[11] 4,169,127

[45] Sep. 25, 1979

[54] CONTAINERS FOR CATALYSTS FOR EXHAUST EMISSION CONTROL

[75] Inventors: Richard Ashworth, Lytham St. Annes; John M. Hargreaves, Stalmine-with-Staynall, Nr. Blackpool, both of England

[73] Assignee: T. I. Silencers Limited, Lancashire, England

[21] Appl. No.: 855,377

[22] Filed: Nov. 28, 1977

[30] Foreign Application Priority Data

Dec. 1, 1976 [GB] United Kingdom ..... 50003/76

[51] Int. Cl.[2] ..... B01J 8/02; B01J 35/04; F01N 3/15

[52] U.S. Cl. ..... 422/180

[58] Field of Search ..... 23/288 FC, 288 FB; 60/299, 301; 29/157 R; 422/171, 180, 177

[56] References Cited

U.S. PATENT DOCUMENTS 3,692,497 9/1972 Keith et al. ..... 60/299 X

FOREIGN PATENT DOCUMENTS 2313166 3/1973 Fed. Rep. of Germany ..... 23/288 FC
2343973 3/1974 Fed. Rep. of Germany ..... 23/288 FC
2248442 4/1974 Fed. Rep. of Germany ..... 23/288 FC
2312794 9/1974 Fed. Rep. of Germany ..... 23/288 FC
2313156 9/1974 Fed. Rep. of Germany ..... 23/288 FC
2417554 10/1974 Fed. Rep. of Germany ..... 23/288 FC

*Primary Examiner*—Michael S. Marcus
*Attorney, Agent, or Firm*—Scrivener, Parker, Scrivener & Clarke

[57] ABSTRACT

In a can-like container for a cylindrical metal or ceramic substrate body for a catalyst for exhaust emission control, a locating element within the can at least at one end of the body has prongs which, on assembly of the can around the body, are forced into the end face of the body to prevent rotation of the body within the can during subsequent use.

7 Claims, 6 Drawing Figures

CONTAINERS FOR CATALYSTS FOR EXHAUST EMISSION CONTROL

SPECIFIC DESCRIPTION

This invention relates to the construction of containers for receiving catalysts to be placed in the exhaust systems of internal combustion engines, primarily those of road vehicles, for breaking down the unburnt products in the exhaust gases and thereby reducing the quantity of pollution emitted.

One known form of catalyst structure comprises a ceramic honeycomb with the catalyst deposited in its interstices. These ceramic bodies have given rise to severe problems in locating them securely, bearing in mind the inevitable differential thermal expansion and the mechanical weakness of the ceramic material. An alternative to the ceramic body is a honeycomb of sheet metal, made for example for superimposing alternate layers of corrugated sheet and flat sheet. In one known structure of this kind, a composite sheet comprising one corrugated layer and one flat layer is rolled up to form a cylindrical body and is located in a sheet metal cylindrical container which has frusto-conical inlet and outlet ends. The catalyst itself is deposited in the channels of the honeycomb structure.

Even these metal catalyst-supporting bodies have been found to move under the repeated heating and cooling to which they are subjected in use. In particular where (as is usually the case) the body and the container are of circular cross-section the body is liable to rotate.

There have been many proposals in earlier patent specifications for locating the catalyst body against both lateral and longitudinal movement in the container despite repeated heating and cooling and despite differential thermal expansion. For example in German Auslegeschrift No. 24 38 092 it has been proposed to provide projections, for example flanges or spikes, projecting radially inwards from the outside cylindrical wall of the container and into the catalyst-supporting body. The aim of this construction is to prevent axial movement. It is also known to locate the body axially between two spiders that each extend across a respective end of the container.

The aim of the invention is to provide a simple and very economical way of locating the catalyst-supporting body not only axially but also against rotational movement within a cylindrical container. According to the invention it is proposed that at least one of the two ends of the catalyst-supporting body should be engaged by one or more prongs provided on a locating element that is secured within the container and extends across that end of the body, the prong or prongs being forced into the material of the body sufficiently to key the body to the container and prevent rotation.

For example the prong or prongs may be provided on a spider that extends across that end of the body; the spider may be made of intersecting metal strips, with their ends welded or otherwise secured to the wall of the container. The dimensions and placing of the spider are preferably such that the act of assembling the components of the container together around the catalyst-supporting body forces the prong or prongs into the body to the required extent.

Preferably there are such spiders, each with at least one prong, at both ends. Although the invention is primarily applicable to catalyst-supporting bodies of the metal honeycomb type, it may also be applied to the ceramic type.

The invention will now be further described by way of example with reference to the accompanying drawings, in which.

Figure 6:
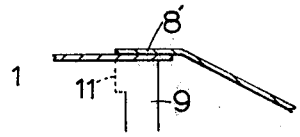
FIG. 6 is a detail view showing a further possible modification.
Figure 1:
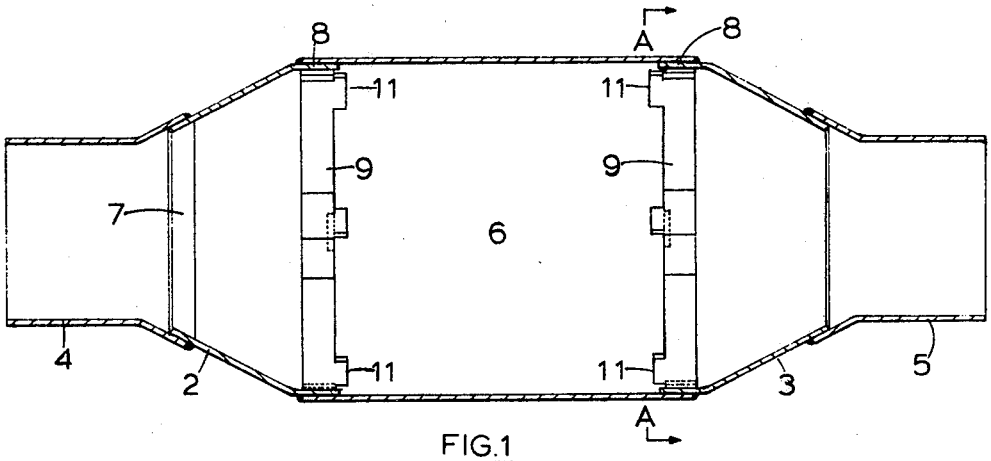
FIG. 1 is a longitudinal section on the axis of a catalyst container according to the invention.
Figure 2:
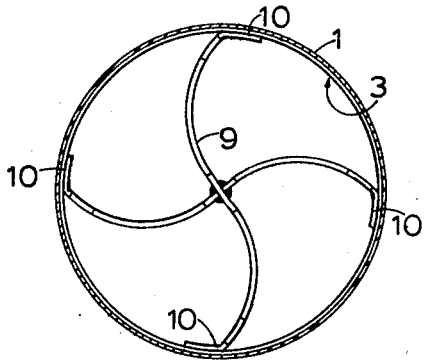
FIG. 2 is a transverse section through the container of FIG. 1, taken on the line A—A in FIG. 1.

The container illustrated in the drawings is of known general construction, comprising a round cylindrical central portion 1, basically frusto-conical inlet and outlet portions 2 and 3, and basically cylindrical inlet and outlet connecting stubs 4 and 5. The container is made of sheet metal and is designed to receive a cylindrical catalyst-supporting substrate body 6 which substantially fills the central portion 1 of the container.

A Vee-section strip 7 is welded diametrically across the entry end of the inlet portion 2 with its apex upstream and serves to spread the incoming stream of exhaust gases and discourage them from flowing only through the central part of the body 6.

The ends of the inlet and outlet stubs 4 and 5 are flared, as shown, and each welded to the smaller end of the associated frusto-conical inlet or outlet portion.

Figure 5:
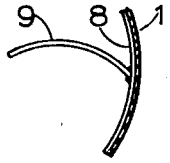
FIG. 5 is a detail view showing an alternative way of securing the ends of the spider to the wall of the container.
Figure 3:
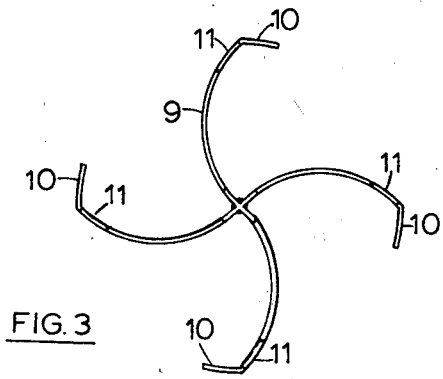
FIG. 3 shows one of the spiders used in the container, looking axially.
Figure 4:
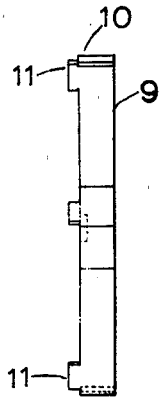
FIG. 4 shows the spider of FIG. 3, looking perpendicular to its axis.

The larger ends of the inlet and outlet portions 2 and 3 terminate in cylindrical flanges 8 that fit into the ends of the central portion 1. Across each flange extends a four-legged spider 9 made up of two intersecting metal strips welded together at their intersection. The strips are set edge - on to the flow of exhaust gases and their free ends 10 are bent over to extend circumferentially, for easy spot-welding to the insides of the flanges 8. FIG. 5 shows an alternative construction in which the bent-over portions are omitted and the strips are arc-welded to the insides of the flanges 8.

The legs of the spiders 9 are curved to allow free thermal expansion without stress.

Formed on one edge of each leg of each of the spiders 9 there is a prong 11, the prongs being on the edges which face towards the body 5. In the example shown the prongs are of rectangular profile and quite shallow, only 2.5 mm measured in a direction parallel to the axis of the container.

The spiders are welded in place in the mouths of the inlet and outlet portions 2 and 3 before those portions are joined to the central portion 1. First one of the portions 2 or 3 is welded to the central portion, then the body 6 is inserted, and then the other portion 3 or 2 is mounted with its flange 8 in the end of the portion 1 and the assembly is placed in a jig that forces this portion 3 or 2 axially to an accurately controlled extent or under a predetermined axial load so that the prongs 11 on both spiders 9 are forced into the end faces of the body 6 to a predetermined extent, locally crushing and deforming the material of the body, and those prongs form a positive key between the body and the container. The remaining portion 3 or 2 is then welded to the cylindrical portion 1 under these conditions.

Alternatively the body 6 could be placed in the central cylindrical portion 1 before either of the end portions 2 or 3 is fitted, then both these end portions are fitted and welded in place simultaneously.

It will be appreciated that the provision of the prongs 11 engaging the end faces of the catalyst-supporting body 6 ensures that this body is securely prevented from rotating within the container, even under severe thermal conditions, and this result is achieved at negligible cost, and without any additional components.

In a further alternative construction, illustrated in FIG. 6 the spiders 9 could be a sliding fit in the central portion 1 and could be inserted from opposite ends, with the body 6 already in place, then subjected to a predetermined axial load or a predetermined axial displacement to force the prongs 11 into the body 6 to the required degree, whereupon the spiders are welded to the portion 1. The inlet and outlet portions 2 and 3 are then welded on later, for example fitting onto, rather than into, the portion 1, as indicated at $8^1$ in FIG. 6.

We claim:

1. A container for receiving a catalyst structure for controlling the emissions in the exhaust system of an internal combustion engine, said container comprising a round cylindrical central portion adapted to receive a cylindrical catalyst-bearing body and inlet and outlet end portions, at least one locating element secured within the container adjacent the position to be occupied by an end face of said body, at least one prong on said locating element placed to dig into the adjacent end face of said catalyst-bearing body and locally crush or deform said end face a predetermined extent sufficient to key the body to the container to prevent rotation of the body with respect to said container about the axis thereof.

2. The container set forth in claim 1 having a locating element at each end of said container and at least one said prong on each of said elements.

3. A container for receiving a catalyst structure for controlling the emissions in the exhaust system of an internal combustion engine, said container comprising a round cylindrical central portion adapted to receive a cylindrical catalyst-bearing body and inlet and outlet end portions, at least one locating element adjacent the position to be occupied by an end face of said body, at least one prong on said locating element placed to dig into the adjacent face of said catalyst-bearing body and thereby prevent rotation of the latter with respect to said container about the axis thereof, said locating element comprising a spider having legs extending across said container and secured by the ends of said legs to said container.

4. The container set forth in claim 3 wherein said inlet and outlet portions are frusto-conically shaped and, each of said inlet and outlet portions have flanges that fit into the ends of said cylindrical portion, said spider being secured in said flange.

5. The container set forth in claim 3 wherein said inlet and outlet portions are frusto-conically shaped and said inlet and outlet portions have flanges that fit over the ends of said cylindrical portion, said spider being secured directly in the associated end of said cylindrical portion.

6. The container set forth in claim 3 wherein said spider is made up of metal strips set edge-on to the intended direction of flow through said container and said prong is formed on an edge of said metal strip.

7. The container set forth in claim 6 wherein said prong has a depth, measured along the axis of said container, of substantially 2.5 mm.

* * * * *